US005479986A

United States Patent [19]

Gano et al.

[11] Patent Number: 5,479,986

[45] Date of Patent: Jan. 2, 1996

[54] TEMPORARY PLUG SYSTEM

[75] Inventors: John C. Gano, Carrollton; Jim Longbottom, Whitesboro, both of Tex.; Bill W. Loughridge, Duncan; Lance E. Brothers, Ninnekah, both of Okla.

[73] Assignee: Halliburton Company, Houston, Tex.

[21] Appl. No.: 236,436

[22] Filed: May 2, 1994

[51] Int. Cl.[6] ..... E21B 33/13

[52] U.S. Cl. ..... 166/292; 166/192

[58] Field of Search ..... 166/285, 292, 166/376, 192

[56] References Cited

U.S. PATENT DOCUMENTS

| | | | |
|---|---|---|---|
| 3,362,476 | 2/1968 | Van Poollen | 166/192 X |
| 4,154,303 | 5/1979 | Fournier | 166/317 |
| 4,160,484 | 7/1979 | Watkins | 166/317 |
| 4,186,803 | 2/1980 | Mondshine | 166/292 |
| 4,216,830 | 8/1980 | Fredd | 166/319 |
| 4,374,543 | 2/1983 | Richardson | 166/192 |
| 4,423,773 | 1/1984 | Stout | 166/51 |
| 4,433,702 | 2/1984 | Baker | 137/527.6 |
| 4,541,484 | 7/1985 | Salerni et al. | 166/278 |
| 4,597,445 | 7/1986 | Knox | 166/319 |
| 4,691,775 | 9/1987 | Lustig et al. | 166/317 |
| 4,721,159 | 1/1988 | Ohkochi et al. | 166/376 X |
| 4,813,481 | 3/1989 | Sproul et al. | 166/51 |
| 5,188,182 | 2/1993 | Echols, III et al. | 166/376 |

*Primary Examiner*—William P. Neuder
*Attorney, Agent, or Firm*—William M. Imwalle; Shawn Hunter

[57] ABSTRACT

A method and apparatus for establishing a fluid plug within a well bore which can then be substantially destroyed upon demand to permit reestablishment of the well within a short period of time thereafter. Increased pressure actuates a plug rupture mechanism which destroys the integrity of the plug and allows the plug to be substantially eliminated from the wellbore within a short period of time thereafter. In described preferred embodiments, the plug is comprised of a salt and sand mixture which is highly resistant to fluid compressive forces but is subject to destruction under shear tension forces. The plug may be encased within a plug sleeve which is, in turn, encased within a plug housing which may be disposed within the well bore. The sleeve is associated within the housing so that fluid may be displaced about the plug sleeve as the housing is disposed into the well bore. When the plug has reached the proper position within the well bore, the plug sleeve may be set within the housing such that fluid flow is stopped. A shear member is contained within the plug sleeve and detachably connected thereto. When required, the shear member may be released from the surrounding plug sleeve and forced against the plug to substantially destroy the integrity of the plug through introduction of shear tension forces within the plug structure and reestablish fluid flow through the housing. The plug is further dissolved into well bore fluids to substantially destroy it.

26 Claims, 7 Drawing Sheets

TEMPORARY PLUG SYSTEM

BACKGROUND OF THE INVENTION

1. Field of the Invention

This invention relates to closure means for well conduits. More particularly, it relates to temporary plugs that are removable without mechanical intervention from the surface above the well.

2. Description of the Related Art

In conventional practice, when a well conduit is desired to be temporarily closed off, it is common to set a plug within the conduit to preclude the flow of fluids at the preferred location. Regarding oil and gas wells, there are may types of plugs that are used for different applications. As an example, there are known removable plugs typically used during cementing procedures that are made of soft metals that may be drilled out of the conduit after use. Plugs that may be removed from a well intact are referred to as "retrievable" plugs. Removal, however, requires mechanical intervention from the surface of the well. Common intervention techniques include re-entry into the well with wireline, coiled tubing, or tubing string.

After a conventional type plug has been set and it subsequently becomes necessary to reestablish flow, any tools that have been associated with the plug during its use must be removed or "pulled" from the well to provide access to the plug for the removal process. The pulling of tools and removal of the plug to reestablish flow within a downhole conduit often entails significant cost and rig downtime. It is, therefore, desirable to develop a plug which may be readily removed or destroyed without either significant expense or rig downtime.

Known conduit plugs incorporating frangible elements that must be broken from their plugging positions include frangible disks that are stationarily located within tubular housings and flapper type elements. Breakage may be initiated by piercing the plug to cause destructive stresses within the plug's body, mechanically impacting and shattering the plug, or increasing the pressure differential across the plug until the plug is "blown" from its seat. After breakage has occurred, the resulting shards or pieces must be washed out of the well bore with completion fluid or the like in many situations. Because most known designs call for a relatively flat plug to be supported about its periphery, the plug commonly breaks from the interior outwardly and into relatively large pieces.

In some cases, operations within a well will require that a temporary plug be set within a conduit, usually the tubing string or well casing, but it may also be tubular components associated with downhole tools being used in the well. An example of such a downhole tool is a pressure set packer. In a typical configuration, the packer assembly will have a tail-pipe extending below the pack off elements. A temporary plug will have been installed in the tail-pipe before the packer is placed within the well or will be installed during the setting process. Frangible plugs described hereinabove may be used to plug the tail-pipe. Alternative plug means may include a wireline disposed plug, a wireline disposed dart, or a seated ball. In any event, after the packer has been set, it is desirable that the plugging structure be removed in order to establish a passage way through the packer assembly. As previously described, a frangible plug in the packer must be mechanically broken from its seat. In the case of a ball seated in a collet catcher sub, sufficient pressure must be applied above the packer to expel the ball into the well beyond the packer assembly.

A common detriment of either the destroyed frangible member or the expelled ball is that potentially fouling debris remains in the well. The debris' significance increases in non-vertical wells because it may remain relatively localized at the location of dislodgment where continuing well activity and operations may take place, or at least pass in the future. The debris may also be carried upward in the well fouling equipment along the way or surface equipment at the top of the well. This should be contrasted to vertical wells where the debris is more likely to fall clear of working mechanisms, but may also create fouling problems.

SUMMARY OF THE INVENTION

The present invention provides a method and apparatus for establishing a temporary fluid-type plug within well conduits that can be removed upon demand to permit fluid flow past the plugged point within a short period of time. It is anticipated that the plug apparatus and methods disclosed herein will be applicable in any size conduit. The dimensions of the plug will be dependent upon the area to be plug and the service conditions into which it will be placed. Degradation and removal of the plug is accomplished without mechanical intervention from the well's surface. Furthermore, the resulting debris or "fall out" from the removed plug comprises sufficiently small particles that are easily transported by the fluids of the well without blocking or fouling other aspects and equipment of the well. These benefits, as well as others that will become apparent from the disclosure made herein, provide time and cost savings to a well operator.

In one or more of the embodiments described herein, the plug has a radial edge which is vulnerable to the application of non-uniform shearing forces. The plug may be destroyed through application of increased pressure upon the housing carrying the plug that actuates a plug rupture mechanism which in turn destroys the integrity of the plug proximate its radial edge. This allows the plug to be substantially eliminated from the blocked conduit within a short period of time thereafter.

The plug is comprised of a salt and sand mixture which is highly resistant to fluid compressive forces but is subject to destruction under non-uniform shear forces proximate the radial edge and tensile forces at any location. The plug is encased within a plug sleeve. The sleeve is encased within a plug housing which may be disposed within the well bore. In an exemplary embodiment, the sleeve is associated with the housing so that fluid may be displaced about the plug sleeve as the housing is disposed into the well bore. In this capacity, the plug allows the well fluids to pass therethrough and fill the tubing above the plug during disposal into the well. This prevents the tubing from having to be filled from the surface to balance the hydrostatic pressures inside and outside the tubing. When the plug has reached the desired location within the wellbore, the plug sleeve is positioned within the housing so that fluid flow is blocked. This is considered to be a "check" position because the plug is blocking fluid flow in one direction (downward) in this position while it would permit flow in the other direction (upward).

An annular shear member presenting a point stress portion is contained within the plug sleeve and detachably connected thereto. When required, the shear member is released from the surrounding plug sleeve and the point stress portion forced against the radial edge plug to substantially destroy the plug structure. The plug material is substantially dissolvable within the well bore fluids to permit reestablishment of fluid flow therethrough and operations within the well bore shortly thereafter.

An apparatus commonly referred to as a plug assembly for temporarily closing a subterranean fluid conducting conduit which may include well casing, tubing string, or conduits within downhole equipment is illustrated, disclosed and claimed herein. The plug assembly includes a tubular housing disposed within the fluid of a subterranean well. There is a temporary plug positioned within the housing for blocking fluid passage through that housing. Also positioned within the housing is a mechanical fracturing means for breaking the temporary plug so that fluid flow through the housing is permitted. The temporary plug is constructed at least partially from material that is dissolvable in the well fluid. The dissolvable portion of the temporary plug includes an aggregate and binder that are solidified into a substantially rigid frangible member that is the plug body. Because the binder dissolves in the well fluid, the individual pieces of aggregate are released one from the other. By including the aggregate, the time required to dissolve the binding material is hastened because the aggregate falls away from the binder thereby exposing increased amounts of surface area of the binder to the dissolving well fluids. The size of the aggregate is such that each particle is sufficiently small so that it will not impede other operations performed within the well after the plug deteriorates. It is contemplated that the aggregate may also be dissolvable in the well fluids. The speed with which the aggregate dissolves in the well fluid would, however, differ from the time it take the binder to dissolve.

In an exemplary embodiment, the aggregate is sand particles and the binder is salt. To assure that the sand particles do not foul other operations, it has been found to be advantageous, but not critical, to employ sand particles having a diameter of about 1 millimeter.

In one preferred embodiment, the temporary plug is at least partially contained within a dissolving resistant encasement composed of substantially pure binder. A means for piercing the encasement to allow the well fluid access to the interior of said temporary plug may be provided.

A method for utilizing the above described temporary plug will include installing a temporary frangible plug within a housing located within a fluid conducting conduit and then disposing that housing into a well so that the plug is submerged in well fluid. The temporary plug is then fractured so that it breaks into pieces that are unsupportable within the housing and subsequently permits fluid flow through the housing. The plug is then dissolved into particles small enough that will not foul future operations within the well.

In another preferred embodiment, the temporary plug has an interior core of unbound aggregate contained within a flexible membrane. The aggregate is vacuum packed within the membrane so that the temporary plug is substantially rigid while the vacuum is maintained within the membrane. To remove the temporary plug, a means for piercing said membrane is provided that opens an avenue for allowing the well fluid access to the interior of the temporary plug. A corresponding method of utilizing this embodiment includes installing the temporary plug within the housing that is located within a fluid conducting conduit. The housing is then disposed into a fluid filled well so that the plug is submerged. The membrane is then pierced so that the vacuum pressure (differential across the membrane) is balanced to allow the previously substantially rigid plug to collapse and become unsupportable within the housing. As a result, fluid flow is similarly permitted through the housing. After collapse, the loose aggregate is released from the membrane and removed away from the housing by the well fluid.

Still another embodiment has a temporary plug supported within a housing at a periphery of the plug. The plug is substantially spherically dome shaped. Due to this shape, the forces experienced in the plug are almost exclusively compressive in nature. This may be contrasted with known frangible disks which are flat and vulnerable to breakage because of the tensile and shear stresses induced during operation. In a flat frangible disk, great tensile forces may be experienced on the lower face of the plug body that is away from the applied pressure while great shear forces are experienced about the periphery of the disk at the points where the edge of the disk bears upon the support structure. In combination, these stresses compromise the integrity of the flat disk's operation.

It may be similarly stated that the invention disclosed herein includes a frangible plug for disposal in a well bore to block fluid flow therethrough. The plug has a radial edge and is substantially rupturable upon the application of non-uniform shear forces proximate the edge of the plug. After rupture, the plug is substantially eliminated from the well bore by dissolving the resultant pieces in the well fluids. A method for employing the plug will include disposing the frangible plug within a well bore to block fluid flow therethrough. After use, the plug is then disposed of by using a plug rupture mechanism proximate the plug which is actuatable by the introduction of increased pressure within the plugged conduit. In one embodiment, the plug rupture mechanism comprises a pair of nested radial support members which are selectively separable to alter radial support of the plug thereby rendering the plug vulnerable to substantial destruction by well bore pressure.

Alternative embodiments are described wherein the plug is comprised of vacuum packed aggregate within a flexible encasement or made of a ceramic or glass material or of liquid soluble metals.

DETAILED DESCRIPTION OF PREFERRED EMBODIMENTS

Figure 1A:
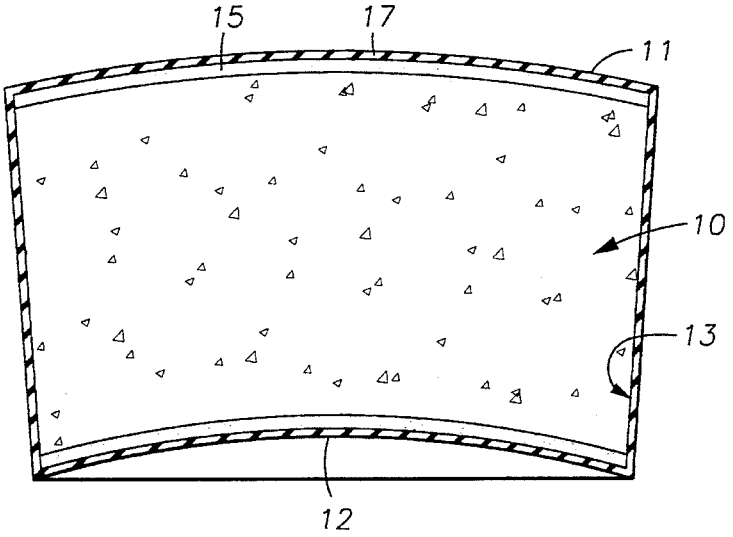
FIG. 1A through 1C depict alternative embodiments of an exemplary plug constructed in accordance with the present invention.

Referring to FIG. 1A, there is shown an exemplary, temporary plug 10 having a convex upper side 11 and concave lower side 12, as well as an upwardly, outwardly angled vertical, conical surface 13. The interior portion of the plug 10 may be comprised of any material, or combinations of materials, that will either dissolve into the well fluids or break down into particles sufficiently small that those particles do not foul other components of the well or services performed therein. It is anticipated that the plug 10 will typically be comprised of a small aggregate and a binder material. The binder will usually be dissolvable in the well fluids and the aggregate will be small enough that it becomes suspended in the well fluids for transport therewith. In the event that the well fluids are too thin to support the aggregate, then the individual particles will be small enough that their presence does not interfere with other operations within the well. An example of an acceptable binder is salt and an example of an acceptable aggregate is sand. The use of sand in the plug's 10 composition assists the breakdown of the plug material in the well fluid after the initial integrity of the plug 10 is mechanically destroyed. The sand increases the porosity and permeability of the plug 10, thereby providing greater surface area upon which the dissolving forces of the fluid can act.

As shown, plug 10 is comprised of a salt and sand mixture. In a preferred embodiment, the sand is very fine and has substantially no particles larger than 1 millimeter in diameter. The salt may be of the granulated "table salt" variety. The exact proportions of sand to salt are not critical; a mixture of approximately 50% of each by weight has been found to be acceptable. A small amount of liquid is added to the mixture so that a plug 10 may be formed by densifying and solidifying the constituent materials under pressure and heat.

The plug 10 is formed in an. appropriately shaped mold to which the pressure and heat are applied. The temperature must be sufficient to drive off the moisture in the sand and salt mixture. In typical downhole applications in oil and gas wells, the resulting molded plug 10 should be capable of enduring compressive forces on the order of 3000 pounds per square inch (psi) and temperatures of 100° C. The plug should also have been sufficiently compressed so that it resists vibrations experienced within the well environment.

In one embodiment, the surface areas of the plug 10 that are exposed to well fluid are sealed. At the same time, the plug 10 should be sufficiently brittle to be vulnerable to shear destructive forces such as upon the application of a point stress of a selected magnitude.

It is supposed that the pressures to be contained by the plug 10 will be from above. Therefore, the plug 10 is oriented to contain those pressures while minimizing the amount of tensile stress experienced within the body of the plug 10. It is anticipated, however, that the plug 10 could be oriented to contain pressures from below, or any other direction. Therefore, in the exemplary illustrations the plug is upwardly arced shaped to provide optimum resistance against downwardly acting fluid compressive forces in a well bore. It is noted that in the preferred embodiment of FIG. 1A, the arc of concave surface 12 would correspond roughly to a segment of a smaller sphere than that to which the arc of convex surface 11 corresponds. Surface 13 is preferably angled outwardly in a conical shape. It should be appreciated, however, that the dimensions of the plug 10 are governed by the distance it must span to plug a particular conduit, and therefore are variable.

The integrity of the salt and sand plug 10 just described may be improved by the application of a thin protective fluid impermeable coating 15, such as epoxy, upon surfaces 11 and 12 to seal the plug surface against the well fluid. In addition, portions of the exterior of the plug 10 may be encased in a flexible sheath or encasement 17 for protection against the well bore fluids. Neoprene rubber or other soft rubbers are suitable for constructing the encasement 17.

Alternatively, the plug material within the encasement 17 may be only sand which is vacuum packed therein. The vacuum pressure within the encasement 17, having a magnitude of approximately one atmosphere, will maintain the sand grains in dense engagement with each other to prevent relative motion therebetween. It should be understood that the relative pressure upon the encased material will increase as the plug 10 is disposed further into the well due to hydrostatic pressure. Therefore, during operation, the vacuum pressure applied to the aggregate will be equal to the hydrostatic pressure, plus one atmosphere. When it is desired to remove such a vacuum packed plug 10 from a conduit, the encasement 17 is punctured or otherwise ruptured causing the contained sand to be liberated and the encasement to collapse. It is also possible that the sheath or encasement 17 will break into several pieces. Therefore, the sheath 17 should be thin enough so that resulting pieces do not present impedances to tools disposed within the well bore following destruction of the plug. Still further, the encasement 17 may be constructed from a material that will eventually dissolve in the well fluids, but not within the expected service time of the plug 10.

Figure 1B:
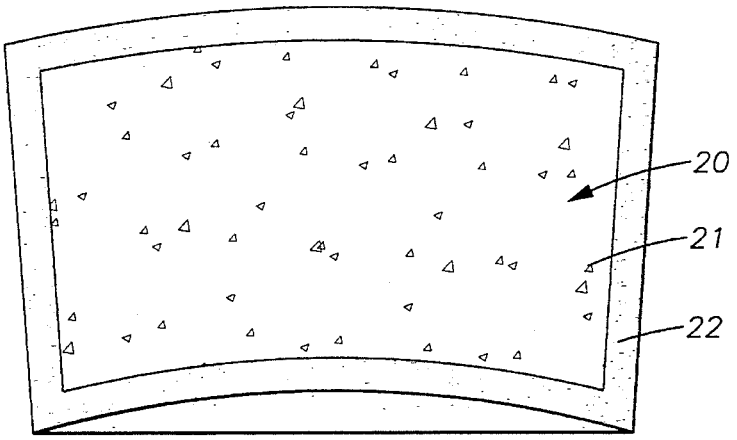
Figure 1C:
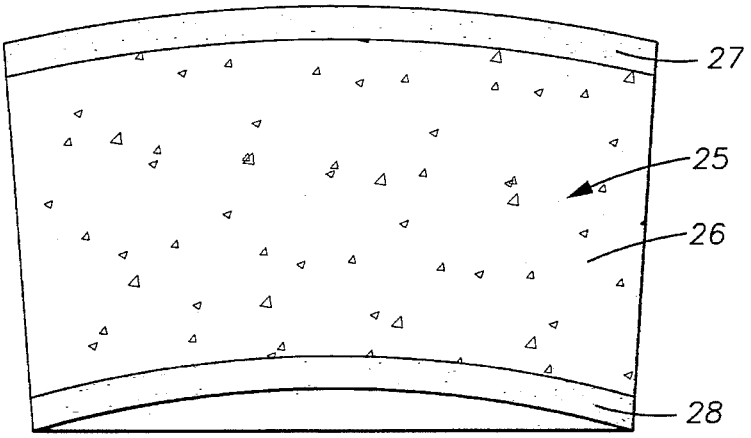

Referring now to FIG. 1B, an alternative embodiment of a plug 20 is shown which is shaped substantially the same as plug 10. Plug 20 contains a central portion 21 which may be comprised of a sand/salt mixture as previously described. An outer crust 22 is formed around the central portion 21. FIG. 1C illustrates a variation on plug 20 in which caps 27 and 28 are constructed similarly to the crust 22. The crust 22 may be comprised of substantially 100% binder which is compressed and heated to be formed integrally with the central portion 21 of the plug 20. In an exemplary embodiment, salt has been utilized as the crust 22 Testing has shown that plug material formed substantially of all salt is more resistant to compressive forces and degradation from well bore fluids than plug material of a salt/sand mixture. Therefore, a crusted combination as illustrated provides a stronger plug that initially retains its rigid form but subsequently breaks down quickly once the crust erodes allowing well fluid into the central portion. During construction of the plug 20, the thickness of the crust 22 will be governed by the desired time period before the soluble crust is sufficiently dissolved to expose a portion of the central portion 21, following which destruction of the plug occurs rapidly.

Figure 2A:
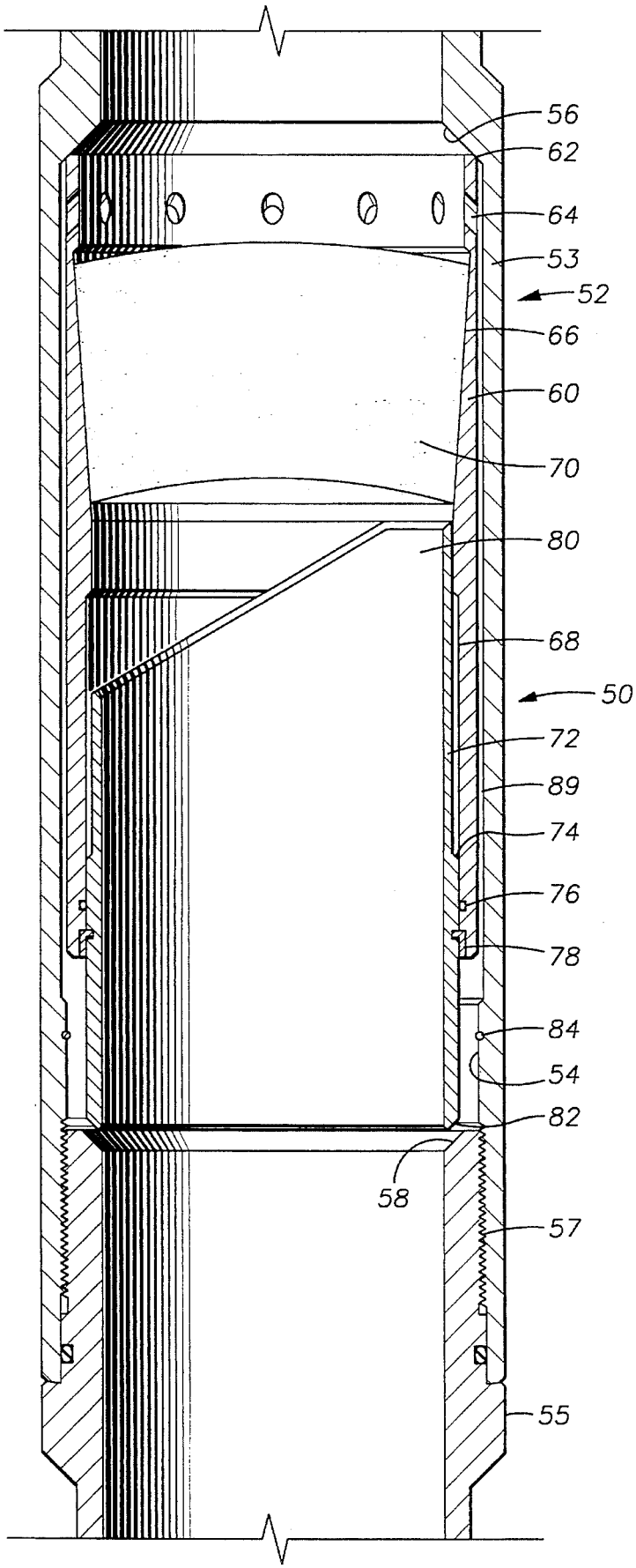
FIG. 2A depicts a plug assembly constructed in accordance with the present invention during disposal within a well bore.

Turning now to FIG. 2A, an exemplary plug assembly 50 is shown which includes an outer plug housing 52 which is substantially tubular in shape and adapted to be connected in a tubing string (conduit) disposed within a well bore in which a temporary plug is desired. The housing 52 includes an upper section 53 threadedly connected at joint 57 to a lower section 55. Upper section 53 has a radially enlarged bore section 54 having a downwardly facing, inward frusto-conical shoulder 56 and the upper terminal end of lower section 55 forms an upwardly facing, frusto-conical sealing shoulder 58. Upwardly facing sealing shoulder 58 is preferably angled inwardly at an approximate angle of 45°.

Within the radially enlarged bore section 54 is slidably disposed a plug sleeve 60 having an upper longitudinal end 62 adapted to contact the upper inwardly disposed annular shoulder 56 of the housing 52. Fluid flow ports 64 are disposed about the circumference of the sleeve 60 proximate upper end 62. Sleeve 60 also forms a tapered conical section 66 which is downwardly, inwardly tapered and disposed below the flow ports 64. A radially expanded section 68 is disposed below the conical section 66 and forms an annular bearing portion 69 between sections 66, 68. Downward shoulder 75 is disposed about the interior circumference of sleeve 60.

Within the tapered section 66 of sleeve 60 is disposed a frangible plug 70 which may be of any one of the types described or depicted with respect to FIG. 1A–1C. The plug 70 is preferably tightly received within the conical section 66. In one preferred embodiment, the plug 70 may be formed and prestressed within the tapered section to afford it greater strength against liquid compression forces while disposed within a well bore. Alternatively, the plug may be formed separately and pressed and bonded into the sleeve with a suitable sealing glue compound, such as rubber cement or the like. In any event, the interior central portion of the plug will be shielded from the well fluid.

An annular shear member 72 is disposed within the sleeve 60 and features an upper reduced diameter portion 61 forming an outwardly facing annular shoulder 74 which is received within the radially expanded section 68 of the sleeve 60. The upper terminal end of member 72 is supported by bearing portion 69. One or more elastomeric seals 76 may be used to seal the connection between shear member 72 and the sleeve 60. A shear ring 78 detachably connects the sleeve 60 to the shear member 72. Shear member 72 presents a point stress portion 80 directed toward the plug 70. Preferably, the point stress portion comprises an arcuate support shoulder 81 located proximate a portion of the bottom radial edge of plug 70 and an arcuate tapering non-supporting shoulder 83 which tapers downwardly from support shoulder 81 and away from the bottom of plug 70. Shear member 72 presents a lower annular frusto-conical shoulder 82 adapted to sealingly engage shoulder 58. In operation, the shear ring 78 will preferably require a preselected shear force to shear and release shear member 72 from sleeve 60. A lock wire 84 is disposed about the inner circumference of the enlarged bore section 54.

The plug assembly 50 is assembled substantially as shown in FIG. 2A during running of the plug assembly 50 into a well bore. Fluid is displaced around the plug 70 as the plug assembly 50 is disposed into the well bore. The resistance presented by the fluid in the well causes plug 70, shear member 72 and sleeve 60 to be carried in an upper most position during downward travel through the fluid. In the upper position, fluid from below flows between shoulders 82 and shoulder 58, into the annular area 89 formed by sleeve 60 and housing 52, and ultimately through flow ports 64 upwardly into flow bore 91.

Figure 2B:
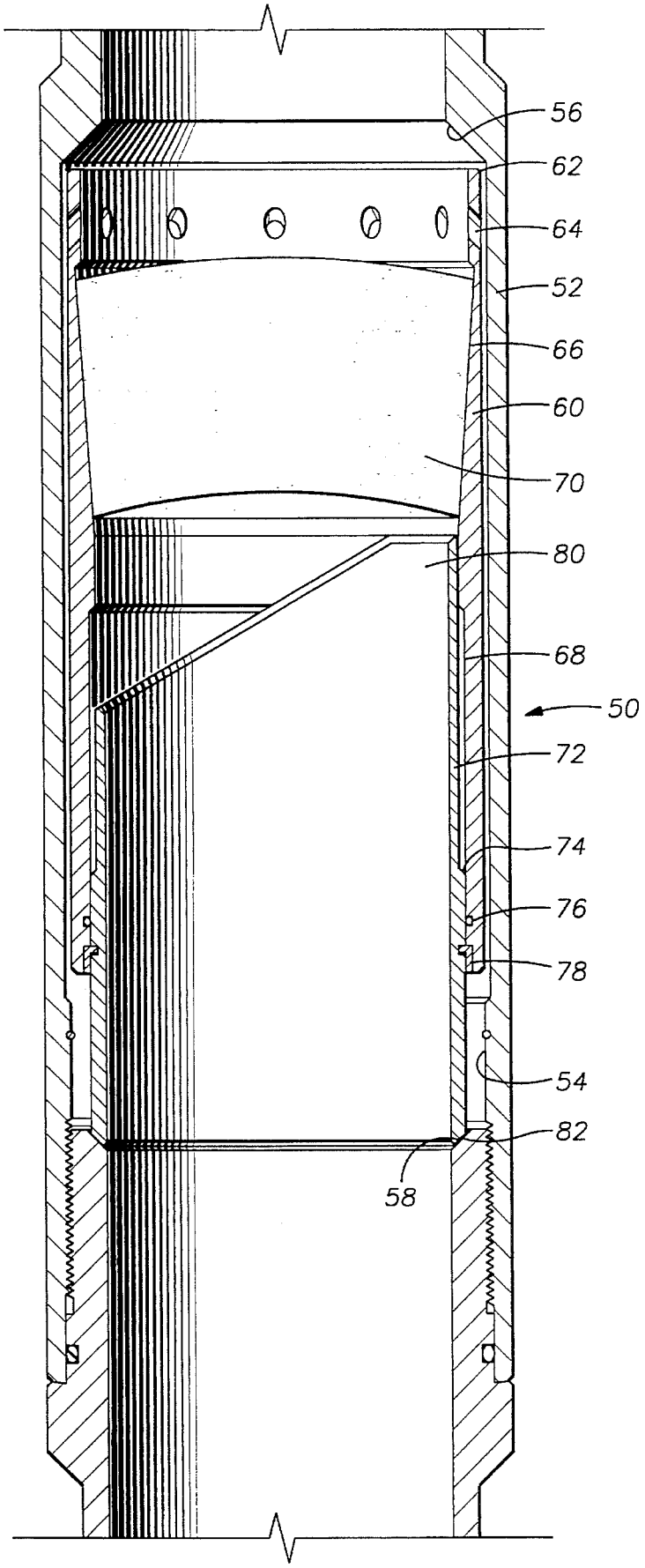
FIG. 2B depicts a plug assembly constructed in accordance with the present invention with the plug set against fluid flow.

When the plug assembly 50 has been disposed to the proper depth within the well bore, fluid pressure is applied to the top of the plug 70 causing the plug 70, shear member 72 and sleeve 60 to shift downwardly, as illustrated in FIG. 2B such that sleeve 60 moves downwardly within housing 52 until shoulder 82 meets and seals against shoulder 58, thereby establishing a metal-to-metal seal against fluid flow. In this position, the plug assembly 50 seals against fluid transfer across the plug 70.

Figure 2C:
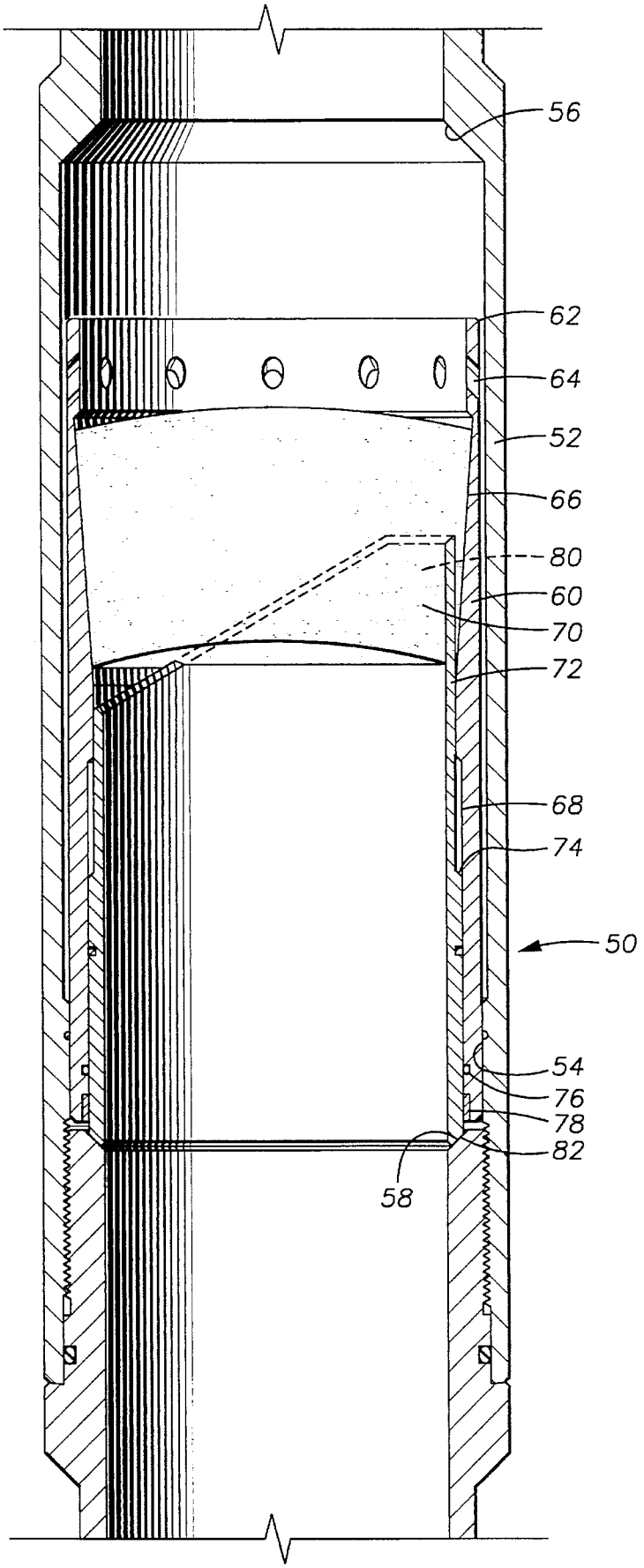
FIG. 2C depicts destruction of the plug by the shear member.

When it is desired to break down the plug 70, sufficient fluid pressure is applied to plug 70 to force the downward movement of sleeve 60 within housing 52. Downward movement of sleeve 60 will result from pressurizing the interior of housing 52 to a degree sufficient to cause shear ring 78 to shear. FIG. 2C illustrates this operation. Once shear ring 78 is sheared, the fluid pressure on top of the plug 70 and sleeve 60 causes plug 70 and sleeve 60 to snap downward within housing 52 since sleeve 60 is no longer supported by shear ring 78. The plug 70 is then forced downwardly against the arcuate support shoulder 81 of point stress portion 80 of shear member 72 that acts as a plug rupture mechanism. Point stress portion 80 applies non-uniform shearing forces proximate the radial edge of plug 70. The non-uniform shear forces applied by the shear member 72 are sufficient to pierce any protective coating or encasement that may be present and then break the frangible plug 70 into pieces. Downward movement of the sleeve 60 with respect to shear member 72 will ultimately be limited by the engagement of opposing shoulders. Lock wire 84 maintains housing 52 and sleeve 60 in non-sliding engagement after the sleeve 60 has moved downward.

Once the plug 70 has been broken into smaller pieces or the interior exposed to the well fluids, complete break down follows soon thereafter. The salt in the plug 70 is dissolved by the well bore fluid, leaving the sand to unconsolidate and either innocuously settle in the well or blend with the well fluids.

Figure 3:
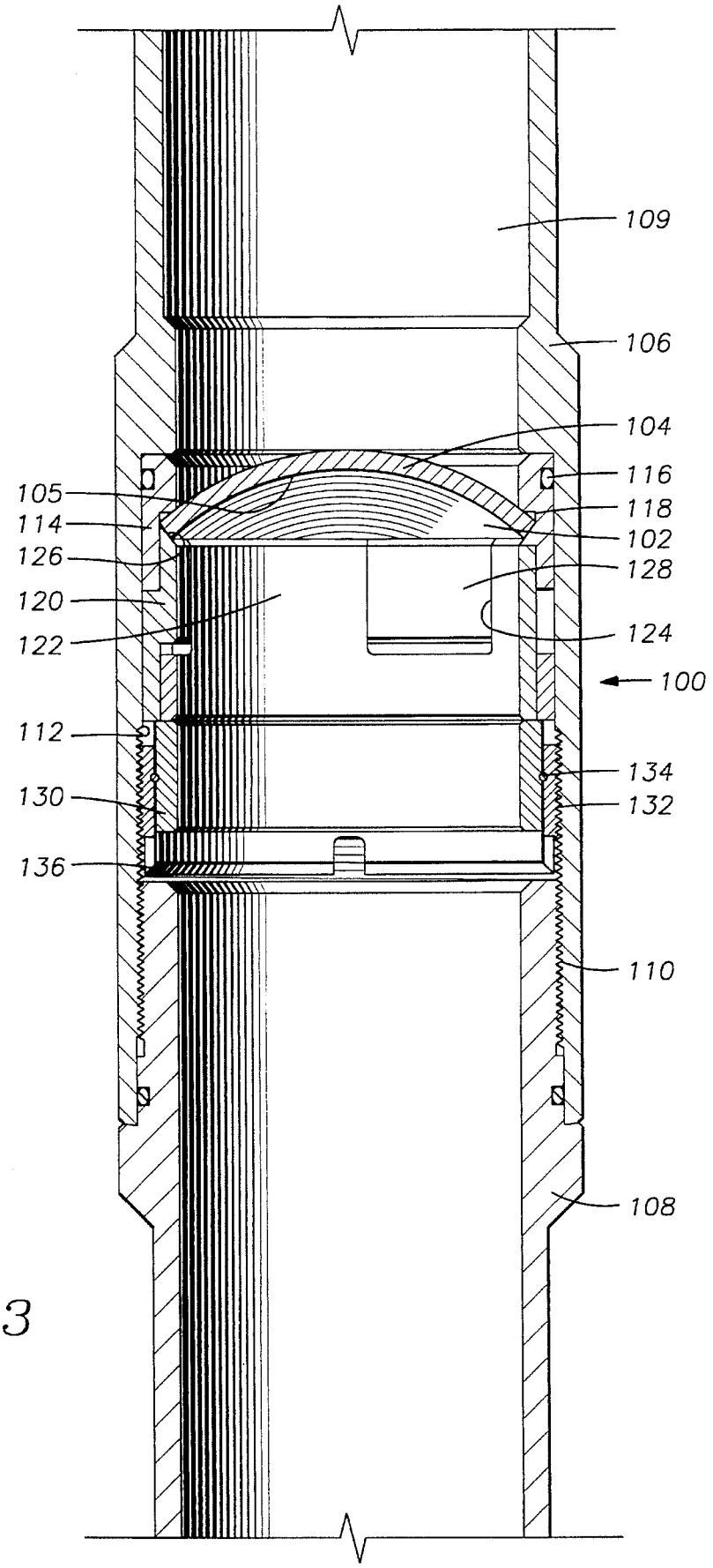
FIG. 3 depicts an alternative plug assembly wherein the plug is comprised of a domed glass or ceramic material.

FIG. 3 depicts an alternative embodiment of the present invention featuring a plug assembly 100 having a plug 102 made of rigid and brittle material such as glass or ceramics. The ceramic or glass plug 102 may take a form different from that of the plugs previously described, but have similar effectiveness as a fluid barrier. Plug 102 may be considerably thinner than the sand and salt type plugs described earlier and be substantially dome shaped with the radii of curvature of upper and lower surfaces 104 and 105 being roughly the same.

Plug assembly 100 includes an upper housing 106 and lower housing 108 which form a flow bore 109 therethrough. The upper and lower housing 106 and 108 are threadedly connected at 110 to form a radially enlarged bore section 112. Plug 102 is disposed in a fixed relation within upper housing section 106 so as to block fluid flow through fluid flow bore 109; by orienting the plug 102 so that the convex portion of the dome is upwardly facing, a greater fluid force may be resisted for above the plug 102. Fluid flow will, however, be blocked in both directions. An upper piston 114 radially surrounds and contacts the outer edges of upper surface 104 of plug 102. O-rings 116 and 118 ensure a fluid tight seal between the plug 102 and the piston 114. Plug 102 is supported radially by outer support member 120 and inner support member 122 which is nested therewithin. Inner support member 122 is an annularly shaped ring-type member having a number of slots 124 cut into its upper portion. It also presents inwardly facing upper arcuate shoulders 126 upon which the radial edges of plug 102 are seated. Outer support member 120 is also an annularly shaped, ring-type structure which surrounds inner support member 122 and presents inwardly projecting protuberances which reside within slots 124 when inner support member 122 is nested within outer support member 120. Sleeve 130 supports the outer and inner support members 120 and 122. Sleeve 130 is detachably connected to ring 132 by means of a shear wire or other shear mechanism 134. Ring 132 is seated on shear member 136 which abuts the lower housing 108.

In operation, the plug 102 will resist downward compression through flow bore 109 as the glass or ceramic structure of plug 102 will be predominantly stressed by relatively uniform compressive forces since the edges of the plug 102 are firmly supported between the piston 114 above and the inner and outer support members 120 and 122 below.

If it is desired to destroy plug 102, a pressure must be applied into flow bore 109 which exceeds the shear value of the shear wire 134. For this reason, the value of the shear wire or other shear mechanism must be set in excess of those operating pressures under which plug 102 is designed to resist. Increased pressure downward through flow bore 109 will act across the surfaces of plug 102 and piston 114, urging them downwardly along with outer and inner support members 120 and 122 and sleeve 130. When shear wire 134 is sheared, inner sleeve 130 will move downward with respect to ring 132 and shear member 136. As this occurs, ring 132 blocks downward movement of outer support member 120 but not inner support member 122. The radial support of the edges of plug 102 at shoulders 126 will now be removed and plug 102 will be supported solely by the protuberances 128 of the outer support member 120. This creates non-uniform shear forces proximate the edges of the plug 102. The lack of uniform support for the plug 102 will allow the pressure within the flow bore 109 to destroy plug 102 thereby acting as the plug rupture mechanism. Ideally, the plug 102 breaks into a number of small pieces as a result of the stress patterns. Once ruptured, the pieces of plug 102 should be sufficiently small so as not to foul other operations subsequently performed within the well. As a result, the plug 102 is substantially eliminated from the wellbore.

In a variation of this embodiment, it is contemplated that a water soluble metal may be used to construct the plug 102. After physical destruction of the metal plug, the well bore fluids dissolve the plug fragments within a short time thereafter.

Figure 4:
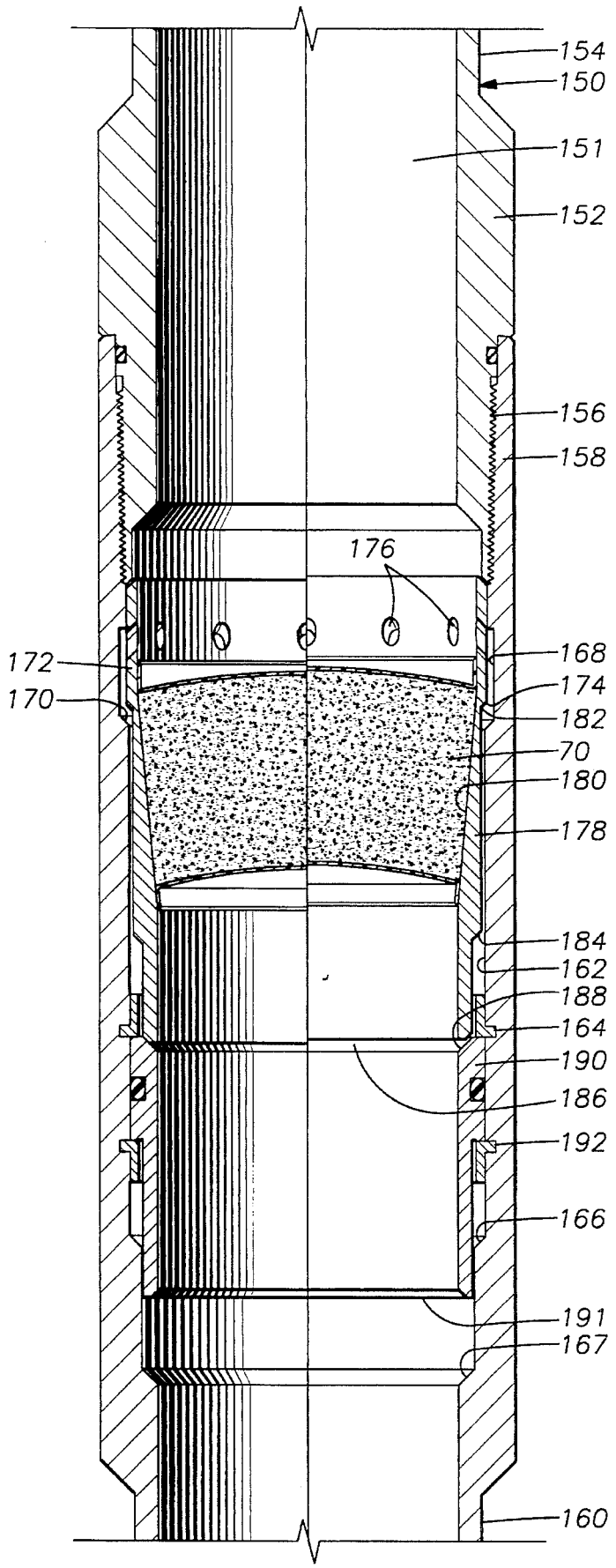
FIG. 4 and 5 depict an embodiment in which selective well fluid access is provided by breaking the sleeve in which the plug body is carried.
Figure 5:
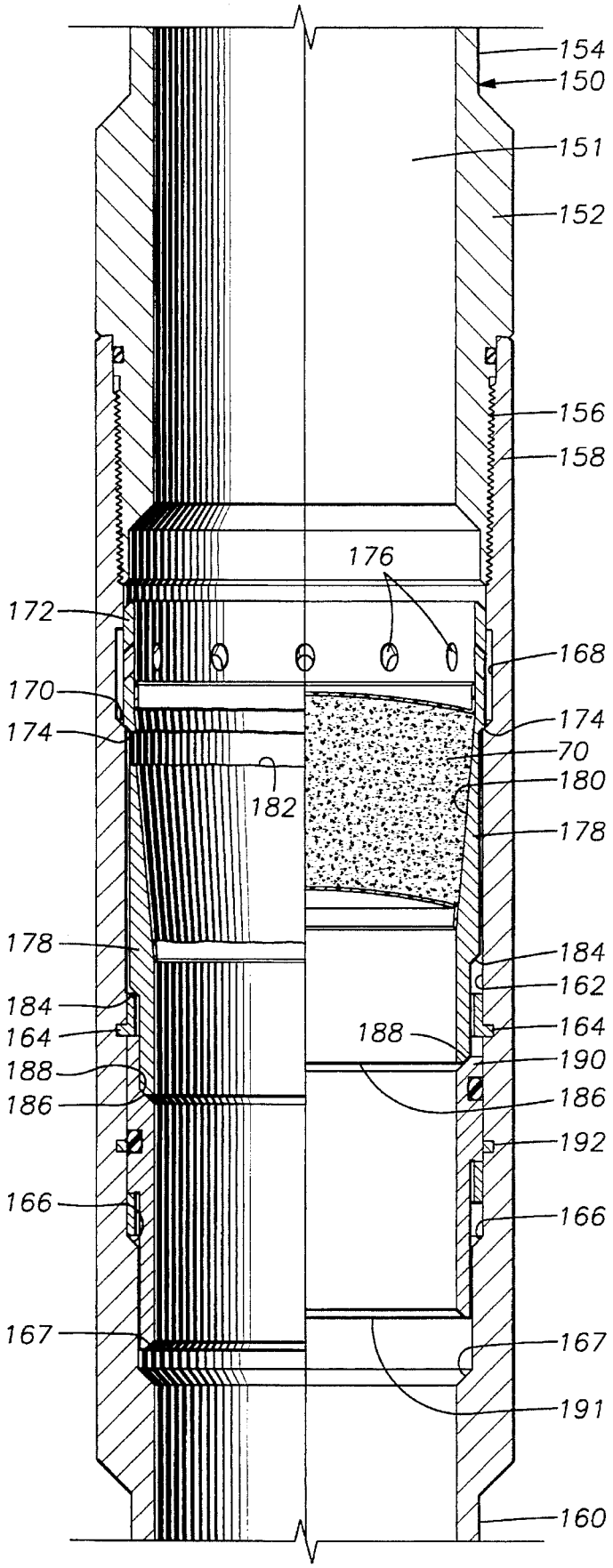
Figure 2A:
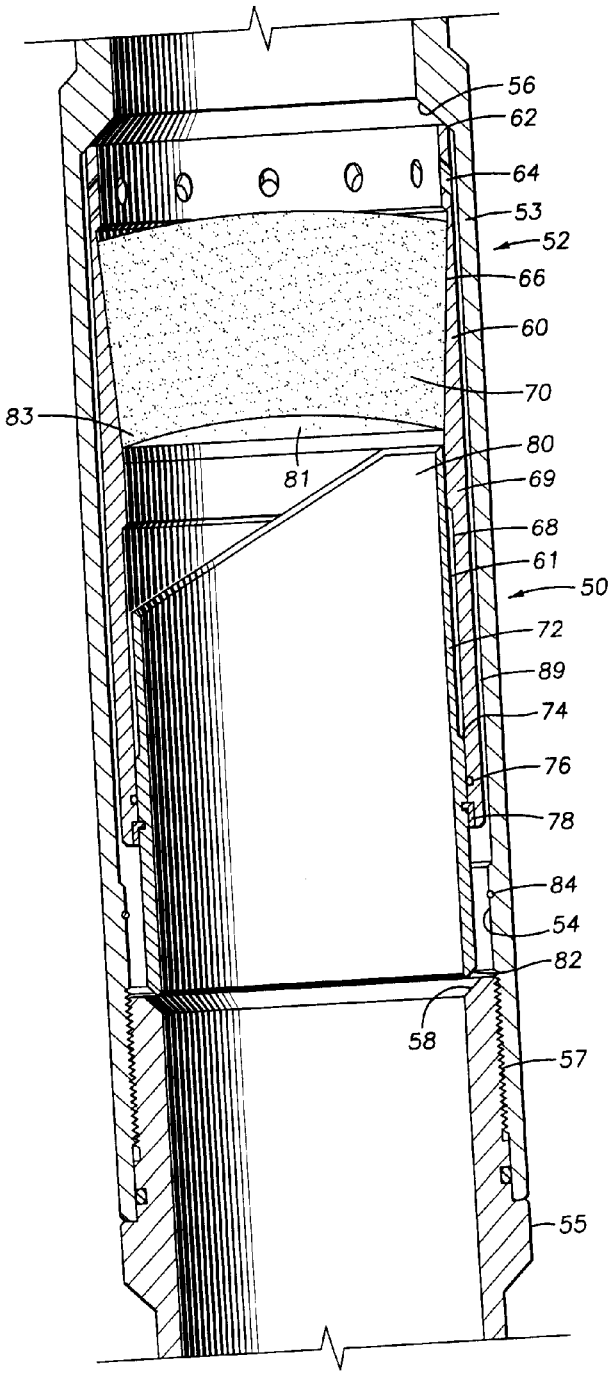

A further exemplary embodiment of the present invention is shown in FIGS. 4 and 5. In this embodiment, the plug rupture mechanism provides selective well fluid access to portions of the radial edge of the plug 70 which are readily degradable by fluid contact. It is noted that plugs which are suitable for use in plug assemblies of this type are those constructed similar to or shown in FIG. 1A–C.

FIGS. 4 and 5 illustrate cross-sectional views of an exemplary plug assembly 150. To aid in illustrating the operation of the plug assembly 150, the figures present juxtaposed halves of the tool in different stages of operation. The right half of FIG. 4 illustrates the assembly 150 as it would appear while being disposed downwardly within the well bore and permitting fluid flow upwardly around the plug 70. The left half of FIG. 4 shows the plug assembly 150 set for fluid flow blockage. The right half of FIG. 5 shows the plug assembly 150 after initial plug rupture. The left half of FIG. 5 illustrates the configuration of the assembly 150 following substantial destruction of the plug 70.

The assembly 150 includes an upper adaptor 152 with upper threads or other connector means 154 which permit the assembly 150 to be incorporated within a conduit. Upper adaptor 152 is connected at thread 156 to plug housing 158. Plug housing 158 includes lower adaptor threads 160 for connection with other portions of a conduit. A central portion of housing 158 includes sleeve bore 162 having inner upward facing shoulders 164, 166 and 167.

Above sleeve bore 162 is radially expanded fluid flow bore 168 which presents an annular upward facing shoulder 170. Annular ring 172 is disposed proximate fluid flow bore 168 within the housing 158 and features an annular lower shoulder 174 which is adapted to be generally complimentary to shoulder 170. It is preferred that shoulders 170 and 174 do not form a seal, but, when engaged, will permit fluid flow therebetween. Ring 172 features a number of lateral ports 176 about its periphery.

Sleeve bore 162 contains a sleeve 178 which is slideably received therein. Sleeve 178 presents an outwardly tapered plug support section 180 with an upper ring contacting portion 182. The outer radial surface of sleeve 178 presents a downwardly facing shoulder 184. The sleeve also presents a lower edge 186 which is complimentary to seat 188 of sleeve support member 190. Sleeve support member 190 is shear pinned at 192 to plug housing 158 and features lower edge 191.

During disposal within a well bore, assembly 150 permits fluid flow around the plug sleeve 178 in a manner similar to that described with respect to previous embodiments and as shown in the right side of FIG. 4.

When disposed within a well bore for blockage of fluid flow therethrough as illustrated in the left half of FIG. 4, plug sleeve 178 is moved downwardly within bore 162 until lower edge 186 contacts seat 188 to form a seal against fluid flow therethrough. In this portion, little or no fluid flow is permitted between shoulder 174 and ring contacting portion 182 toward portions of plug 70.

Upon application of increased pressure within the well bore 151, sleeve 178 is shifted downward as shown in the right half of FIG. 5 until downward facing shoulder 184 of the sleeve 178 contacts shoulder 164. Upward facing shoulder 166 may also act to limit downward movement of sleeve support member 190 and edge 191 will ultimately be limited from excessive downward movement by shoulder 167. In this downward position, pressurized fluid within well bore 151 passes through ports 176 outward into radially enlarged fluid flow bore 168 and between shoulders 170 and 174. Due to the separation of ring contacting portion 182 and shoulder 174, fluid is permitted to contact plug 70 proximate its upper radial edge to begin dissolution of the plug 70 as previously described. After a period of time, plug 70 dissolves as shown in the left half of the FIG. 5.

While the invention has been described with respect to preferred embodiments, modifications thereof can be made by one skilled in the art without departing from the spirit of the invention.

What is claimed is:

1. An apparatus for temporarily closing a subterranean fluid conducting conduit, comprising:

a tubular housing disposed within the fluid of a subterranean well;

a temporary plug positioned within said housing for blocking fluid passage through said housing;

a mechanical fracturing means for breaking said temporary plug so that fluid flow through said housing is permitted; and said temporary plug being constructed at least partially from material dissolvable in the well fluid.

2. The apparatus for temporarily closing a subterranean fluid conducting conduit of claim 1, wherein said dissolvable temporary plug comprises an aggregate and binder that are solidified into a substantially rigid frangible member.

3. The apparatus for temporarily closing a subterranean fluid conducting conduit of claim 2, wherein said binder is dissolvable in the well fluid thereby releasing individual pieces of said aggregate one from the other.

4. The apparatus for temporarily closing a subterranean fluid conducting conduit of claim 3, wherein said aggregate is sufficiently small that it will not impede other operations within the well.

5. The apparatus for temporarily closing a subterranean fluid conducting conduit of claim 4, wherein said aggregate is sand particles and said binder is salt.

6. The apparatus for temporarily closing a subterranean fluid conducting conduit of claim 5, wherein said sand particles have a maximum diameter of 1 millimeter.

7. The apparatus for temporarily closing a subterranean fluid conducting conduit of claim 4, wherein said temporary plug is at least partially contained within a dissolving resistant encasement.

8. The apparatus for temporarily closing a subterranean fluid conducting conduit of claim 7, wherein said dissolving resistant encasement is substantially pure binder.

9. An apparatus for temporarily closing a subterranean fluid conducting conduit comprising:

a tubular housing disposed within the fluid of a subterranean well;

a temporary plug being constructed at least partially from material dissolvable in the well fluid, the plug being positioned within said housing for blocking fluid passage through said housing;

said temporary plug comprising a salt binder and an aggregate the aggregate comprising sand particles having a maximum diameter of 1 millimeter and being sufficiently small as to not impede other operations within the well, the aggregate and binder being solidified into a substantially rigid frangible member the binder being dissolvable in the well fluid thereby releasing individual pieces of said aggregate one from the other;

said temporary plug further being at least partially contained within a dissolving resistant encasement of substantially pure binder:

a mechanical fracturing means for breaking said temporary plug so that fluid flow through said housing is permitted; and a means for piercing said encasement thereby allowing the well fluid access to the interior of said temporary plug.

10. A method for temporarily closing a subterranean fluid conducting conduit, comprising the steps of:

installing a temporary frangible plug within a housing located within a fluid conducting conduit;

disposing said housing into a subterranean well so that said plug is submerged in well fluid;

fracturing said temporary plug so that said plug breaks into pieces that are unsupportable within said housing thereby permitting fluid flow through said housing; and dissolving said plug into particles small enough not to foul future operations within the well.

11. An apparatus for temporarily closing a subterranean fluid conducting conduit, comprising:

a tubular housing disposed within the fluid of a subterranean well;

a temporary plug positioned within said housing for blocking fluid passage through said housing;

said temporary plug having an interior core of unbound aggregate contained within a flexible membrane; and said aggregate being vacuum packed within said membrane so that said temporary plug is substantially rigid while the vacuum is maintained within the membrane.

12. The apparatus for temporarily closing a subterranean fluid conducting conduit of claim 11, further comprising:

a means for piercing said membrane thereby allowing the well fluid access to the interior of said temporary plug.

13. A method for temporarily closing a subterranean fluid conducting conduit, comprising the following steps:

installing a temporary plug within a housing located within a fluid conducting conduit wherein said temporary plug has an interior core of loose aggregate contained within a flexible membrane, said aggregate being vacuum packed within said membrane so that said temporary plug is substantially rigid while the vacuum is maintained within the membrane;

disposing said housing into a subterranean well so that said plug is submerged in well fluid; and piercing said membrane so that said vacuum is balanced thereby allowing said substantially rigid plug to collapse and become unsupportable within said housing thereby permitting fluid flow through said housing.

14. The method for temporarily closing a subterranean fluid conducting conduit of claim 13, further comprising the following steps:

releasing said loose aggregate from the membrane; and removing said aggregate away from said housing with the well fluid.

15. An apparatus for temporarily closing a subterranean fluid conducting conduit, comprising:

a tubular housing disposed within the fluid of a subterranean well;

a temporary plug positioned within said housing for blocking fluid passage through said housing;

said temporary plug supported within said housing about a periphery of said plug; and said temporary plug having a substantially spherical dome shape that results in substantially exclusive compressive force generation within said plug during operation.

16. A frangible plug for disposal in a well bore to block fluid flow therethrough, said plug having a radial edge and being substantially rupturable upon application of non-uniform shear forces proximate the edge to rupture said plug.

17. The plug of claim 16 wherein the plug is substantially eliminated from the well bore following rupture by dissolving within said well bore fluids.

18. The plug of claim 16 wherein the plug is substantially comprised of glass.

19. The plug of claim 16 wherein the plug is comprised substantially of a water soluble metal.

20. A method of establishing and removing a temporary plug within a well bore, comprising the steps of:

a. disposing a frangible plug within a well bore to block fluid flow therethrough;

b. disposing a plug rupture mechanism within the well bore proximate said plug, said plug rupture mechanism being actuatable by introduction of increased pressure within the well bore; and c. substantially destroying said plug by introduction of increased pressure within the well bore to actuate the plug rupture mechanism.

21. A method of establishing and removing a temporary plug within a well bore comprising the steps of:

a. disposing a frangible plug within a well bore to block fluid flow therethrough;

b. disposing a plug rupture mechanism within the well bore proximate said plug, the plug rupture mechanism comprising a shear member operable to penetrate the plug to degrade the integrity of the plug, the plug rupture mechanism being actuatable by introduction of increased pressure within the well bore; and c. substantially destroying said plug by introduction of increased pressure within the well bore to actuate the plug rupture mechanism.

22. The method of claim 21 wherein the plug rupture mechanism comprises a pair of nested radial support members which are selectively separable to alter radial support of the plug to render the plug vulnerable to substantial destruction by well bore pressure.

23. A frangible plug for disposal in a well bore to block fluid flow therethrough, said plug having a radial edge and being substantially rupturable upon application of non-uniform shear forces proximate the edge to rupture said plug, said plug being substantially comprised of a salt and sand mixture and further being substantially eliminated from the wellbore following rupture by dissolving within well bore fluids.

24. The plug of claim 23 further comprising a rubber sheath over a portion of the surface of the plug.

25. The plug of claim 24 further comprising an epoxy coating over at least a portion of the surface of said plug.

26. The plug of claim 25 wherein the plug further comprises a cap of relatively all salt over at least a portion of the plug surface.

* * * * *

UNITED STATES PATENT AND TRADEMARK OFFICE

CERTIFICATE OF CORRECTION

PATENT NO. : 5,479,986
DATED : January 2, 1996
INVENTOR(S) : John C. Gano et al.

It is certified that error appears in the above-identified patent and that said Letters Patent is hereby corrected as shown below:

Drawings,
Figure 2A should be replaced with the revised Figure 2A attached.

Signed and Sealed this

Sixteenth Day of December, 2003

JAMES E. ROGAN
*Director of the United States Patent and Trademark Office*